US009956444B2

(12) United States Patent
Eberlein

(10) Patent No.: US 9,956,444 B2
(45) Date of Patent: May 1, 2018

(54) GAS EXTINGUISHING SYSTEM

(71) Applicant: AMRONA AG, Zug (CH)

(72) Inventor: Anselm Eberlein, Hannover (DE)

(73) Assignee: AMRONA AG, Zug (CH)

( * ) Notice: Subject to any disclaimer, the term of this patent is extended or adjusted under 35 U.S.C. 154(b) by 77 days.

(21) Appl. No.: 14/849,650

(22) Filed: Sep. 10, 2015

(65) Prior Publication Data

US 2016/0082297 A1 Mar. 24, 2016

(30) Foreign Application Priority Data

Sep. 22, 2014 (EP) ..... 14185826

(51) Int. Cl.
*A62C 3/00* (2006.01)
*A62C 35/64* (2006.01)
(Continued)

(52) U.S. Cl.
CPC ..... *A62C 3/002* (2013.01); *A62C 35/02* (2013.01); *A62C 35/645* (2013.01); *A62C 35/68* (2013.01); *A62C 99/0018* (2013.01)

(58) Field of Classification Search
CPC .. A62C 99/0018; A62C 99/0027; A62C 3/002
(Continued)

(56) References Cited

U.S. PATENT DOCUMENTS 3,182,669 A * 5/1965 Campbell ..... A62C 3/065 134/105
3,545,485 A * 12/1970 Clark ..... G05D 16/103 137/508
(Continued)

FOREIGN PATENT DOCUMENTS

DE 19811851 C1 1/2001
DE 10 2009039 357 A1 3/2011
(Continued)

OTHER PUBLICATIONS

European Search Report dated Mar. 20, 2015 for European Patent Application No. 14185826.6 filed on Sep. 22, 2014 by Amrona AG., 7 pages.

*Primary Examiner* — Arthur O Hall
*Assistant Examiner* — Tuongminh Pham
(74) *Attorney, Agent, or Firm* — Cesari and McKenna, LLP

(57) ABSTRACT

The present invention relates to a gas extinguishing system for a predefined protected area, particularly small-parts storage systems, wherein the gas extinguishing system comprises an inert gas source and a diffuser system fluidly connected to the inert gas source by a tubing system. The diffuser system comprises a diffuser tube having a plurality of drill holes provided in the surface of the diffuser tube and a pressure reducer allocated to the diffuser tube. In order to be able to achieve non-interactiveness with respect to the diffuser system from the standpoint of the design of the gas extinguishing system, the inventive provides for designing the diffuser system such that a primary baffle pressure measured in absolute bar is at least twice as high as the internal pressure of the diffuser tube during the flooding period dimensioned for the protected area and that the internal pressure of the diffuser tube during the dimensioned flooding period is at a maximum of 2 bar absolute.

20 Claims, 4 Drawing Sheets

(51) Int. Cl.
*A62C 35/68* (2006.01)
*A62C 99/00* (2010.01)
*A62C 35/02* (2006.01)

(58) Field of Classification Search
USPC ..... 169/11, 45, 46, 47; 239/566; 138/42, 138/44; 137/508
See application file for complete search history.

(56) References Cited

U.S. PATENT DOCUMENTS

| | | | | | |
|---|---|---|---|---|---|
| 5,850,876 | A * | 12/1998 | Allison | A62C 35/15 | 169/11 |
| 7,316,429 | B2 * | 1/2008 | Viegener | F16L 37/091 | 285/307 |
| 2003/0094288 | A1 * | 5/2003 | Wagner | A62C 99/0018 | 169/43 |
| 2007/0034387 | A1 * | 2/2007 | Andersen | A62C 99/0027 | 169/16 |
| 2008/0290216 | A1 * | 11/2008 | Lessi | A62C 3/08 | 244/129.2 |
| 2011/0017476 | A1 * | 1/2011 | Fuchs | A62C 3/002 | 169/11 |

FOREIGN PATENT DOCUMENTS

| | | |
|---|---|---|
| EP | 2186546 A1 | 5/2010 |
| WO | WO 2009/112282 | 9/2009 |
| WO | WO 2010/040771 | 4/2010 |

* cited by examiner

GAS EXTINGUISHING SYSTEM

CROSS-REFERENCE TO RELATED APPLICATIONS

The present application claims the benefit of the following commonly assigned European Patent Application Serial No. EP 14 185 826.6, which was filed on Sep. 22, 2014 and is hereby incorporated by reference.

BACKGROUND OF THE INVENTION

Field of the Invention

The present invention relates to a gas extinguishing system for a predefined protected area, particularly in the form of a gridded structural system such as for example a small-parts storage system.

Background Information

It is known that reducing the oxygen concentration in enclosed rooms, which are for example only entered occasionally by humans and in which the furnishings therein react sensitively to the effects of water, to a value of e.g. approximately 12% by volume can counter the risk of fire in the respective spaces. At such oxygen concentrations, most combustible materials can no longer ignite. The main areas of application are IT areas, electrical switching and distribution rooms, enclosed facilities as well as storage areas containing high-value commercial goods.

An inert gas fire extinguisher is thus known for example from EP 2 186 546 A1 which is designed to render an enclosed protected area inert according to different sequences of events.

A further gas extinguishing system is known from DE 198 11 851 C1. This gas extinguishing system is designed to lower the oxygen content in an enclosed room to a predefinable base inerting level and in the event of a fire or when otherwise needed, to rapidly lower the oxygen content further to a certain full inerting level. To this end, the known gas extinguishing system comprises an inert gas source able to be controlled by a control device as well as a system of supply tubes connected to the inert gas source and the protected area through which the inert gas provided by the inert gas source can be fed into the protected area. Either a battery of pressure cylinders in which the inert gas is stored in compressed form, a system for producing inert gas (also informally called a "nitrogen generator") or a combination of both solutions is conceivable as the inert gas source.

The preventative and/or extinguishing effect resulting from rendering a protected area inert is based on the principle of oxygen displacement. As is known, normal ambient air consists of approximately 21% oxygen by volume, approximately 78% nitrogen by volume and approximately 1% by volume of other gases. To effectively lower the risk of a fire starting in a predefined protected area, e.g. in an enclosed room, the oxygen content in the respective space is decreased by introducing an inert gas or an inert gas mixture such as, for example, nitrogen. With respect to extinguishing fire in the case of most solid matter, a preventative effect is for example known to begin once the percentage of oxygen drops below 15% by volume. Depending upon the flammable substances within the protected area, it may be necessary to further lower the percentage of oxygen to, for example, 12% by volume.

It is frequently the case that known prior art gas extinguishing systems designed to extinguish fire in enclosed rooms are not necessarily suited to lowering the risk or extinguishing fires in gridded storage or shelving systems such as for example small-parts storage systems since such storage/shelving systems frequently comprise a plurality of partitions in the form of individual compartments such that it is thereby in particular no longer a case of a single enclosed room. The design of vertical, high-density storage facilities in particular poses great challenges to conventional gas extinguishing systems. Upon a fire, the often very densely packed warehouse racks coupled with the associated high density of material impedes the effective, and above all prompt, extinguishing of the source of the fire.

Particularly in the case of small-parts storage systems such as tray shuttles or revolving shelving systems (paternoster systems), it is frequently necessary when a fire extinguisher system is used to control fire for the protected area to be "gently" flooded with extinguishing or inerting gas so that the extinguishing and/or fire-fighting action will not cause any damage to the storage system nor have any adverse pressure-related effect on the stored material.

Setting forth from a conventional fire extinguishing system designed and configured for enclosed and comparatively gas-tight rooms as described for example in EP 2 186 546 A1 or DE 198 11 851 C1, the present invention is based on the task of further developing same to the effect of being applicable to shelving and storage systems, particularly storage facilities having minimal stock separation in the form of for example vertical shuttle and paternoster systems.

Conventional fire extinguishing systems designed and configured for enclosed and comparatively gas-tight rooms are not readily applicable to such shelving and storage systems because such shelving and storage systems constitute a protected area without an actual gas-tight spatial shell. Whereas a defined protected area in a typical shelving and storage system frequently has an n50 value of 25/h to 50/h, the air exchange rate is significantly lower in enclosed rooms (for instance, a typical n50 value of a cold storage facility is e.g. 0.015/h to 0.03/h), as is recognized in EP 2 186 546 A1 or DE 198 11 851 C1.

Hence, conventional fire extinguishing systems for shelving and storage systems designed and configured for enclosed and comparatively gas-tight rooms are not suitable since, despite the limited quantity of extinguishing agent, it is not possible for such conventional fire extinguishing systems to build up the concentration of extinguishing gas any faster in the predefined protected area nor maintain the concentration of extinguishing gas.

SUMMARY OF THE INVENTION

The task on which the invention is based is solved by a gas extinguishing system in accordance with independent claim 1, whereby the dependent claims set forth advantageous further developments of the inventive gas extinguishing system.

Accordingly, the present invention relates in particular to a gas extinguishing system for a predefined protected area particularly in the form of a gridded structural system such as for example a small-parts storage system, wherein the gas extinguishing system comprises an inert gas source as well as a diffuser system fluidly connected or connectable to the inert gas source by a system of tubes. The inert gas source is designed to provide inert gas at least during a flooding period rated for the protected area. The diffuser system of the inventive gas extinguishing system comprises at least one diffuser tube with a plurality of drill holes in the diffuser tube surface, whereby at least a portion of the inert gas provided by the inert gas source can be introduced radially into the protected area relative to the longitudinal direction of the diffuser tube. Additionally to the at least one diffuser tube, the diffuser system of the inventive gas extinguishing system has a pressure reducer allocated to the at least one diffuser tube comprising a baffle, wherein the pressure reducer is, in terms of the flow, disposed between the tubing system and the at least one diffuser tube.

The providing of a diffuser tube having a plurality of drill holes in the diffuser tube surface enables various advantages to be achieved compared to extinguishing gas nozzles as normally used in conventional gas extinguishing systems configured for enclosed rooms. Firstly, the providing of the at least one diffuser tube enables the inert gas to be introduced into the protected area through numerous small openings (drill holes) in the event of a fire or when needed. This ensures a gentle flow coupled with concurrently optimal dispersion of the inert gas in the protected area. It is thus for example possible for the design of the openings (drill holes) in the surface of the diffuser tube to be individually adapted to the localized circumstances of the protected area. In the case of a vertical shuttle or paternoster system or other such similar warehousing system, which is often up to 30 meters tall, the openings/drillings in the diffuser tube's surface are preferably individually adjusted at different heights within the vertical storage system so that neither trays nor other physical structures can pose an obstacle to the extinguishing gas (inert gas).

It is therefore evident that by making use of at least one diffuser tube, a homogeneous dispersal of inert gas, and thus effective firefighting, can be realized even in a gridded structural system such as for example a small-parts storage system.

On the other hand, the gas extinguishing system according to the invention is characterized by the diffuser system having a pressure reducer with a baffle allocated to the at least one diffuser tube, wherein in terms of the flow, the pressure reducer is disposed between the tubing system, via which the diffuser system is fluidly connected or connectable to the inert gas source of the gas extinguishing system, and the at least one diffuser tube. With respect to the diffuser system, the invention in particular provides designing same such that a primary baffle pressure measured in absolute bar is at least twice as high as the internal pressure of the diffuser tube during the flooding period dimensioned for the protected area and that the internal pressure of the diffuser tube during the rated flooding period amounts to a maximum of 2 bar absolute.

These two design conditions achieve a plurality of advantages. On the one hand, a diffuser system configured as such allows an even distribution of the extinguishing agent (inert gas, particularly nitrogen) in the extinguishing zone of small-parts storage systems at minimum flow load. The gentle flooding of the protected area at a maximum of 2 bar thus achieved ensures that the goods stored in the protected area will not be damaged.

On the other hand, the cited configuration of the diffuser system has the further advantage of the diffuser system constituting, in regulatory terms, a "non-reactive add-on component" to the other components of the gas extinguishing system. "Non-reactive" in this context means that it makes no difference from the point of view of the gas extinguishing system's design whether a diffuser system or a standard extinguishing nozzle (single-jet nozzle) is attached at the end of the tubing system fluidly connected or connectable to the inert gas source.

The advantages thereby attainable are obvious: The configuration of the inventive gas extinguishing system with the cited diffuser system thereby largely corresponds in principle to the standard configuration of a conventional tried-and-tested, e.g. VdS-certified, gas extinguishing system. This applies particularly to the design of the inert gas source (for example as inert gas pressure cylinders), the control system, the tubing system to the defined zone, the apportioning in the protected area/extinguishing zone and to the design of the nozzle bores in the case of standard extinguishing nozzles.

In other words, the configuring and designing of the inventive gas extinguishing system can to the greatest extent possible draw on the experience and the know-how gained or accumulated from configuring conventional gas extinguishing systems with standard extinguishing nozzles.

Moreover, the configuration tools and configuration software already developed and accordingly tested for configuring gas extinguishing systems having standard extinguishing nozzles can be used to configure the gas extinguishing system according to the invention.

The inventive gas extinguishing system thus constitutes a solution which is particularly easily realized and yet effective and is particularly tailored to vertical storage systems.

In order to achieve a dispersing of the inert gas dispensed from the at least one diffuser tube during the flooding period which is as uniform as possible, one preferential realization of the gas extinguishing system provides for designing the at least one diffuser tube such that the same mass flow of inert gas is preferably discharged from all of the drill holes formed in the surface of the at least one diffuser tube during the given flooding period.

This can for example be achieved by the total area of the drill holes corresponding to no more than half the cross-sectional area of the diffuser tube at evenly spaced inert gas flows through the drill holes (area rule). Alternatively conceivable is exceeding this area rule by for example 30% so that the total area of the drill holes corresponds to half the cross-sectional area of the diffuser tube plus 30%. In this case, the mass flows through the drill holes do not differ by more than 10% from each other, which is generally tolerable.

Alternatively or additionally hereto, it is conceivable for the drill holes provided in the surface of the at least one diffuser tube to exhibit a predefined bore diameter. Aside from that, it is of further advantage for production-related reasons for the plurality of drill holes provided in the surface of the at least one diffuser tube to be arranged according to a fixed bore spacing grid.

For example, it is conceivable in this context for an internal diffuser tube diameter of 53 mm to comprise up to 220 drill holes in the diffuser tube surface, each at a respective average diameter of from 2.8 mm to 3.2 mm. Such a diffuser tube enables no diffuser tube interaction on the discharge behavior of the pressure reducer and thus on the discharge behavior of the gas extinguishing system for up to 22 m in length.

According to one aspect of the present invention, it is preferably provided to set the maximum internal pressure in the diffuser tube such that the inert gas is released into the protected area as a subcritical flow during the flooding period configured for said protected area. This condition is then realized for nitrogen, for example, when the internal pressure in the diffuser tube does not exceed double the external pressure; i.e. approximately 2 bar absolute.

In this way, not only does the diffuser tube enable a non-reactive redirecting of the inert gas serving as extinguishing agent from the longitudinal direction of the diffuser tube into a radial direction of flow relative to the diffuser tube, but thereby further achieves that no or at least clearly fewer swirls occur in the protected area, and namely in comparison to drill holes inducing a supercritical flow which is for example the case when the internal diffuser tube pressure is so high that the flow rate in the outlet holes reach sonic velocity and the drill holes thus act like nozzles.

According to one realization of the present invention, it is provided for the diffuser system to be designed such that—relative to the bore surface—the amount of inert gas released into the protected area through the drill holes of the at least one diffuser tube per second during the configured flooding period does not exceed a predefined value of 4.86×105 liter/(s×m2 bore surface), preferably 4.01×105 liter/(s×m2 bore surface), measured at 20° C. and 1.013 bar.

Alternatively or additionally hereto, it is conceivable for the diffuser system to be designed such that—relative to the internal cross-sectional area of the at least one diffuser tube—the amount of inert gas released into the protected area through the drill holes of the at least one diffuser tube per second during the configured flooding period does not exceed a predefined value of 2.92×105 liter/(s×m2 internal cross-sectional area), preferably 2.83×105 liter/(s×m2 internal cross-sectional area), measured at 20° C. and 1.013 bar.

One particularly preferential realization, in which nitrogen or a nitrogen-enriched gas mixture is used as the inert gas, provides for the diffuser system to be designed such that the amount of inert gas released per second into the protected area through each individual drill hole of the at least one diffuser tube during the flooding period configured for the protected area does not exceed a predefined value of approximately 0.004 kg/s and preferably approximately 0.0033 kg/s. Such a configuration selected with respect to the mass flow design ensures the diffuser system's non-interactiveness, whereby the further previously cited advantages are concurrently achieved, particularly the achieving of an even distribution of inert gas in the protected area and the "gentle" flooding of the protected area.

Alternatively or additionally hereto, it is advantageous for the diffuser system to be designed such that the total amount of inert gas released into the protected area through the drill holes of the diffuser tube provided in the diffuser tube surface per second during the flooding period configured for the protected area does not exceed a predefined value of approximately 0.75 kg/s and preferably approximately 0.726 kg/s.

One preferential realization of the inventive gas extinguishing system provides for using nitrogen or a nitrogen-enriched gas mixture as the inert gas, whereby the at least one diffuser tube of the diffuser system has a nominal diameter (DN) of 50 in accordance with DIN EN ISO 6708, wherein a maximum of 220 drill holes having a respective diameter of approximately 2.8 to 3.2 mm are configured in the surface of the at least one diffuser tube, and wherein the drill holes are configured in one section of the diffuser tube having a maximum length of 22 m. This hereby of course relates only to one possible (preferential) configuring of the diffuser system; other, particularly slightly deviating configurations and designs are also conceivable.

It is preferential for the inert gas source of the inventive gas extinguishing system to comprise at least one inert gas pressure tank in which the inert gas is stored in compressed form, preferably at 200 or 300 bar. Thus, components already proven and accepted in conventional gas extinguishing systems can be used to realize the inert gas source. It is of course also possible in this context, alternatively or additionally to the at least one inert gas pressure tank, for the inert gas source to comprise an inert gas generator, particularly a nitrogen generator in the form of a gas separation system.

It is provided according to preferential further developments of the inventive gas extinguishing system, particularly for the vertical positioning of the at least one diffuser tube in the protected area, for the diffuser system to further comprise at least one fluidly connected head pipe arranged between the pressure reducer and the diffuser tube through which inert gas is piped as needed from the pressure reducer to the diffuser tube.

Alternatively or additionally hereto, and particularly dependent on the respective application and the size (height) of the protected area, it is conceivable for the diffuser system to further comprise at least one support tube, particularly for the mechanical support of the diffuser tube, which terminates the at least one diffuser tube at its end region opposite the pressure reducer.

If, however, mechanically supporting the diffuser tube in the protected area is not necessary, the end region of the diffuser tube opposite the pressure reducer should for example be terminated by means of a suitable end cap in order to ensure that the inert gas fed to the diffuser tube is solely discharged into the protected area through the drill holes provided in the diffuser tube surface.

The cited head pipe or support tube respectively particularly serves only in the proper positioning of the diffuser tube with respect to the protected area, or for supporting or height compensation of the diffuser tube respectively, whereby the additional component (head pipe and/or supporting tube) above all has no impact on the non-reactive design of the diffuser system.

With respect to the most even possible dispersion of the inert gas in the protected area, a further aspect of the invention provides for the diffuser tube to be designed as a straight tube section, particularly without bends, angles or T-pieces. Such bends, angles or T-pieces—should these in fact be necessary—are preferably spatially provided ahead of the diffuser system pressure reducer.

With respect to manufacturing the at least one diffuser tube, it is advantageous for same to be formed from a plurality of separately formed segments. This applies in particular when the diffuser tube exceeds a certain overall length. It has proven advantageous in this context for the plurality of separately formed segments to be fluidly connected to one another, particularly in a cold-press connection. This ensures optimal sealing of the interfaces between two adjacent diffuser tube segments, even when the diffuser tube is cooled during the release of the inert gas.

However, other connecting techniques are of course also conceivable such as for example connections which integrate or provide for sealing elements.

In order to be able to realize the most automated fire extinguishing process possible, one preferential further development of the inventive gas extinguishing system provides for same to comprise a detection device, particularly of aspirative design, which is designed to detect at least one fire characteristic in the protected area. In conjunction hereto, it is further advantageous for the gas extinguishing system to comprise a control device designed to preferably automatically control the inert gas source as a function of the fire characteristic monitoring so as to lower the oxygen concentration in the protected area to a predefined inerting level according to a predefined sequence of events within a flooding period set for the given protected area and preferably maintain it at that level for a predefined dwell time.

The term "fire characteristic" as used herein is to be understood as physical variables subject to measurable changes in the proximity of a fire, e.g. the ambient temperature or the solid, liquid or gaseous content in the ambient air such as e.g. smoke particles or aerosols, vapors or fumes.

An aspirative fire detection device is characterized by representative samples of air being extracted from the monitored protected area continuously or at predefined times and/or upon predefined events, whereby the air samples are then fed to a corresponding fire characteristic detector.

In one preferential further development of the latter embodiment in which the gas extinguishing system is designed to initiate the feed of inert gas preferably automatically and as a function of the fire characteristic monitoring, at least one system is provided to detect the oxygen concentration in the protected area. So doing ensures that in the event of a fire or when otherwise needed, the oxygen concentration in the protected area is lowered to or below the predefined inerting level and preferably kept at that level for a predefined dwell time.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
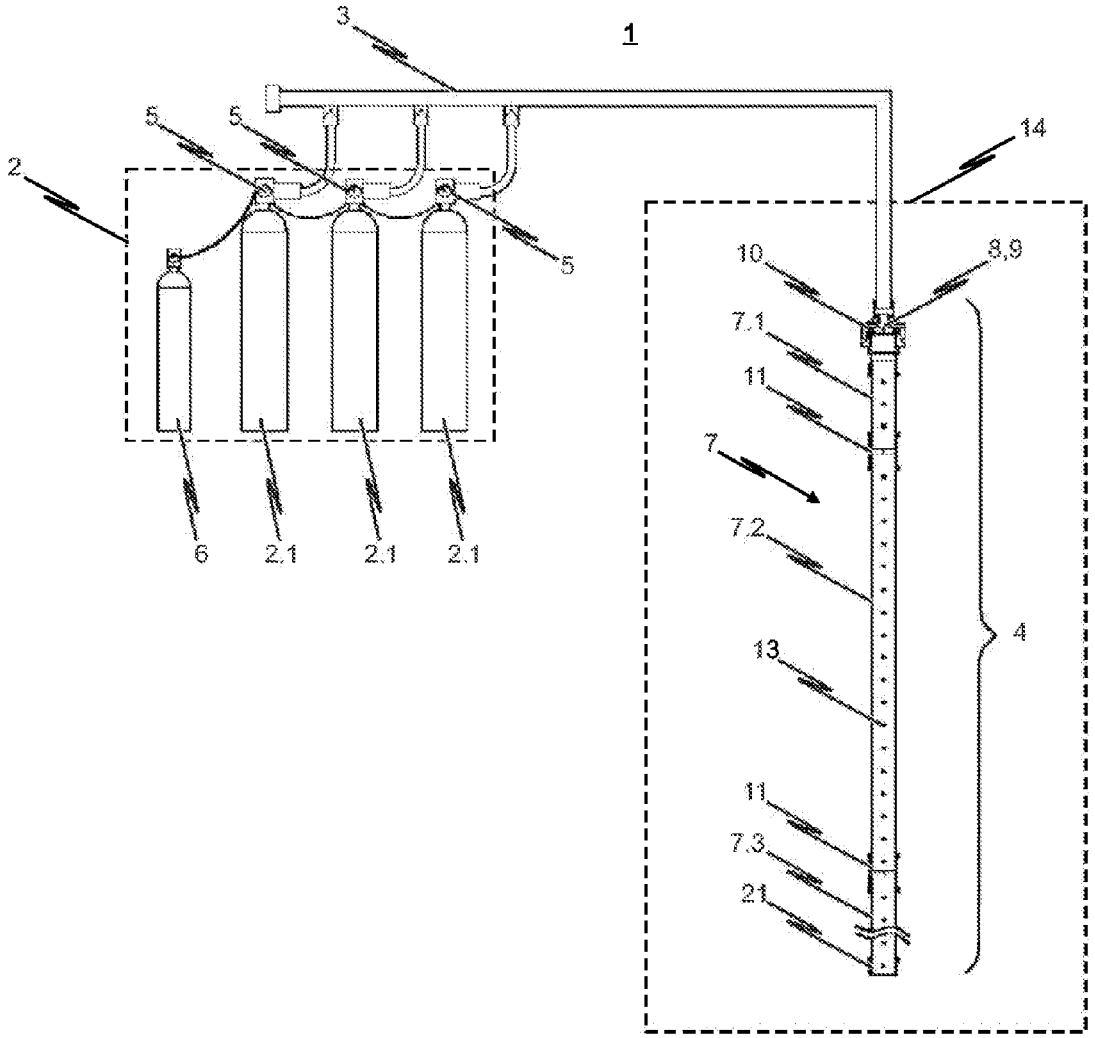
FIG. 1 the basic schematic structure of one exemplary embodiment of the inventive gas extinguishing system.

FIG. 1 depicts the basic schematic structure of an exemplary embodiment of the inventive gas extinguishing system 1. Among the essential components of the gas extinguishing system 1 are in particular an inert gas source 2 as well as a diffuser system 4 fluidly connected or connectable to the inert gas source 2 by means of a tubing system 3.

In the embodiment of the inventive gas extinguishing system 1 depicted schematically in FIG. 1, the inert gas source 2 is formed from a plurality of pressure cylinders 2.1 in which inert gas (here: preferably nitrogen) is stored in compressed form. It is for example conceivable to use commercially available 300 bar cylinders having a 140-liter capacity as pressure cylinders 2.1.

The following will assume that nitrogen or a nitrogen-enriched gas mixture is used as the inert gas for the exemplary embodiments of the inventive gas extinguishing system 1 depicted in the drawings, whereby this is however not to be construed as being limiting. Other inert gases or inert gas mixtures or quenching gases can of course also be used to extinguish a fire.

In the exemplary embodiment of the inventive gas extinguishing system 1 according to FIG. 1, the individual pressure cylinders 2.1 are each fluidly connected or connectable to the end region of the tubing system 3 facing the inert gas source 2 by means of a valve comprising a flow regulator 5. In order for the inert gas (here: preferably nitrogen) stored in the pressure cylinders 2.1 to be fed into the tubing system 3, the respective valves 5 of the pressure cylinders 2.1 are controlled by a control box (here: 200 bar pressure tank having an 80-liter capacity) in the exemplary embodiment depicted schematically in FIG. 1.

The inert gas source 2 as well as the tubing system 3 of the embodiment of the inventive gas extinguishing system depicted schematically in FIG. 1 are configured in customary manner, as is the case with gas extinguishing systems having extinguishing nozzles. Instead of extinguishing nozzles, however, the inventive gas extinguishing system 1 makes use of a (nozzle-free) diffuser system 4.

Figure 2:
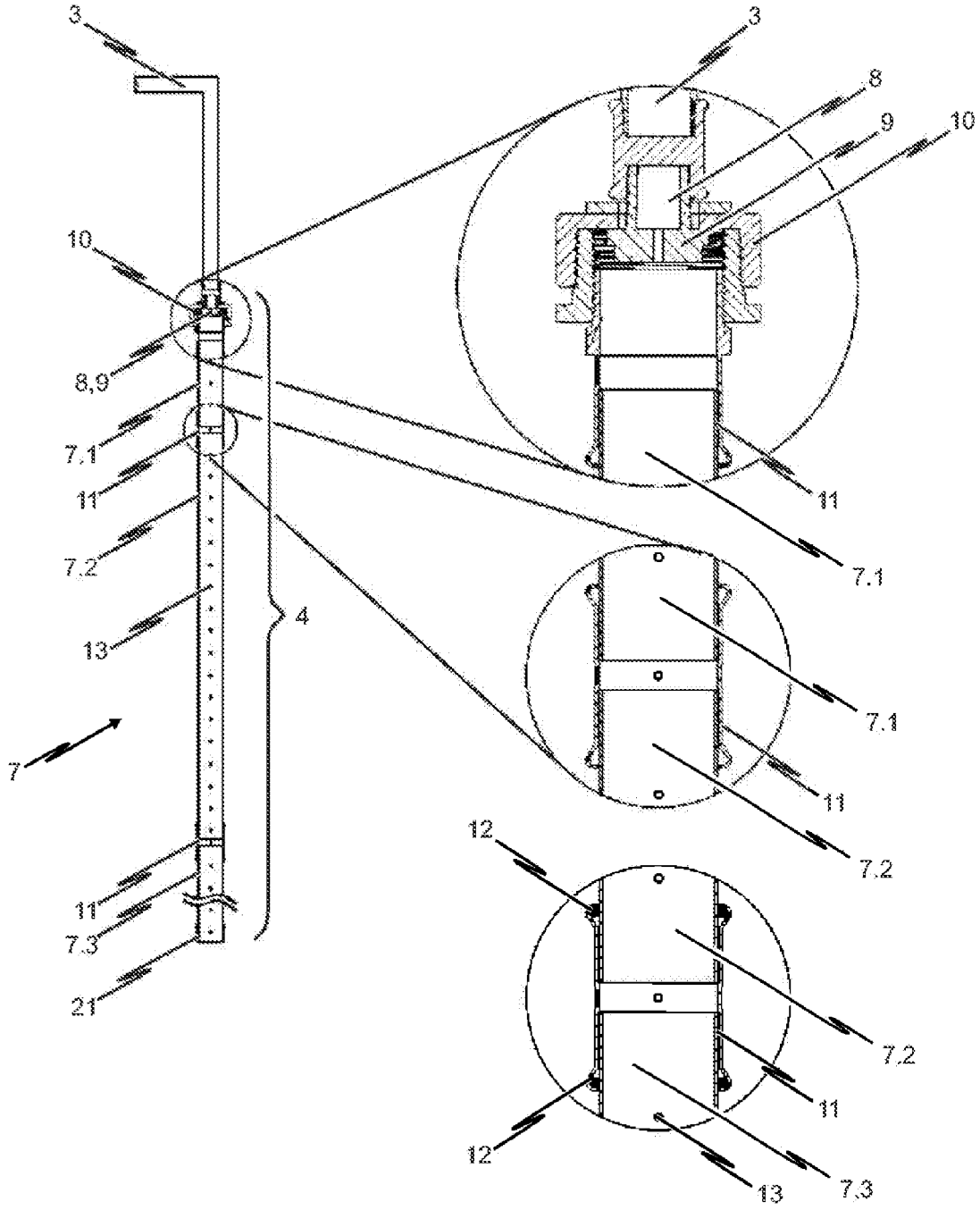
FIG. 2 a schematic depiction of the diffuser system employed in the gas extinguishing system according to FIG. 1 with detailed sectional views of the diffuser system pressure reducer as well as the connection areas between two adjacent and connected diffuser tube segments.

As can be seen particularly from the depiction provided in FIG. 2, the diffuser system 4 consists substantially of a diffuser tube 7 and a pressure reducer 8 allocated to the diffuser tube 7. The structure of the pressure reducer 8 can be recognized in the upper detailed sectional view of FIG. 2.

According thereto, the pressure reducer 8 according to this embodiment comprises a baffle 9 as well an adapter piece 10. The adapter piece 10 fluidly connects the pressure reducer 8 to the end region of the tubing system 3 on the far side from the inert gas source 2. The adapter piece 10 further serves to fluidly connect the pressure reducer 8 to the (in FIG. 2: upper) end region of the diffuser tube 7 such that the pressure reducer 8 with the associated baffle 2 is fluidly arranged between the tubing system 3 and the diffuser tube 7.

The diffuser tube 7 depicted schematically in FIG. 2 is of multi-piece construction and consists of individual segments 7.1, 7.2 and 7.3, whereby two respective adjacent segments 7.1, 7.2 or 7.2, 7.3 of the diffuser tube 7 are in each case fluidly connected together by means of a corresponding connecting piece 11. The connecting piece 11 can be provided with, as indicated in the lower FIG. 2 detail view, a corresponding seal 12; it is however advantageous within the context of the present invention for the connecting piece 11 to cold-press connect with the corresponding end region of the diffuser tube segments to be connected without the use of a seal 12 (cf. the middle FIG. 2 detail hereto).

The diffuser system 4 employed in the exemplary embodiment according to FIG. 1 is designed as a non-reactive add-on component such that it makes no difference from the standpoint of the design of the gas extinguishing system 1 whether the diffuser system 4 or a standard extinguishing nozzle, for example in the form of a single-jet nozzle, is connected to the end region of the tubing system 3 on the far side from the inert gas source 2.

For this reason, the diffuser system 4 in the exemplary embodiment of the inventive gas extinguishing system 1 according to FIG. 1 is designed in such a manner that, on the one hand, a primary baffle pressure measured in absolute bar is at least twice as high as the internal pressure of the diffuser tube 7 during a flooding period dimensioned with respect to the protected area 14 and, on the other, that the internal pressure of the diffuser tube 7 is at a maximum of 2 bar absolute during the configured flooding period.

These design criteria which relate to the primary baffle pressure on one hand and to the internal diffuser tube 7 pressure on the other guarantee the desired non-interactiveness of the diffuser system 4.

Additionally hereto, the exemplary embodiment of the inventive gas extinguishing system 1 depicted schematically in FIG. 1 provides for the inert gas to be able to be released into the protected area 14 associated with the gas extinguishing system 1 via the diffuser tube 7 pursuant to a uniform distributive function.

To this end, it is provided with the gas extinguishing system 1 shown in FIG. 1 for the same mass flow of inert gas to be discharged from all the drill holes 13 formed in the surface of the diffuser tube 7 during the flooding period configured for the protected area 14 associated with the gas extinguishing system 1.

The diffuser tube 7 employed in the inventive gas extinguishing system 1 has a plurality of drill holes 13 provided in its surface via which at least a portion of the inert gas provided by the inert gas source 2 can be introduced into the protected area 14 associated with the gas extinguishing system 1 as needed or in the event of a fire. The diffuser tube 7 thereby serves to redirect the inert gas flow from the longitudinal direction of the diffuser tube 7 into a radial direction relative to the diffuser tube 7 and non-reactively release the inert gas into the protected area.

Preferably, and as schematically indicated in FIG. 2, the respective drill holes 13 provided in the surface of the diffuser tube 7 exhibit a predefined bore diameter, whereby it is of further advantage for production-related reasons for the drill holes 13 to be arranged according to a fixed bore spacing grid.

For the diffuser system 4 to be able to realize the gentlest possible flooding of the protected area 14 associated with the gas extinguishing system 1, it is advantageous for preferably all of the respective drill holes 13 provided in the surface of the at least one diffuser tube 7 to be designed such that the inert gas supplied to the diffuser tube 7 during the configured flooding period is released into the protected area 14 as a subcritical flow. Such a subcritical flow can then at any rate be realized when the respective drill holes consistently exhibit—as seen across the thickness of the diffuser tube 7 wall—a constant cross section and thus in particular do not exhibit a nozzle shape.

The gas extinguishing system 1 depicted schematically in FIG. 3 corresponds substantially to the basic structure of the system described with reference to the FIG. 1 representations. To avoid repetition, the following will refrain from describing similar components of the gas extinguishing system 1 shown in FIG. 3 or components which produce the same effect. Instead, the following remarks concentrate on those aspects of the inventive gas extinguishing system 1 provided additionally in the embodiment depicted schematically in FIG. 3.

Figure 3:
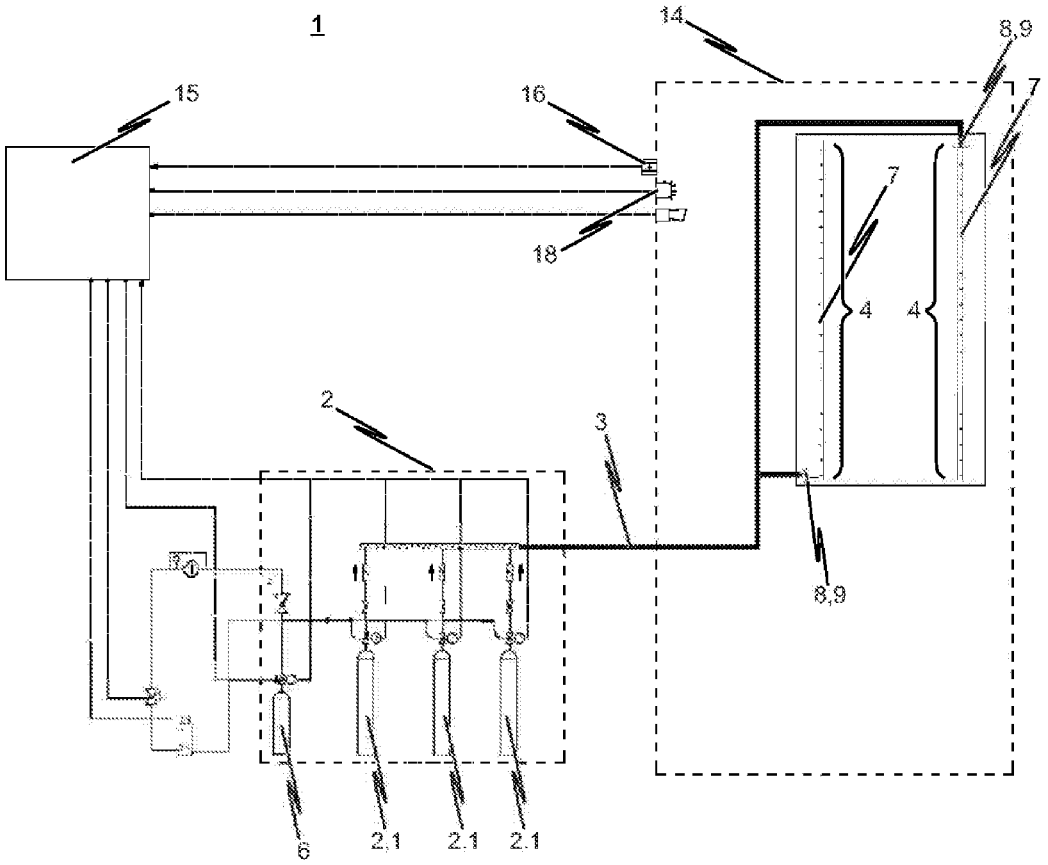
FIG. 3 the basic schematic structure of a further exemplary embodiment of the inventive gas extinguishing system.

As depicted schematically in FIG. 3, the gas extinguishing system 1 shown therein is associated with a specific protected area 14, whereby the present case for example relates in particular to a small-parts storage system such as a vertical high-density storage system (shuttle or paternoster system).

A total of two diffuser systems 4 are arranged on the tubing system 3 of the gas extinguishing system 1 depicted schematically in FIG. 3, their respective diffuser tubes 7 aligned vertically. The inert gas is fed into the respective diffuser tubes 7 from below in the diffuser system 4 depicted on the left in FIG. 3 whereas the inert gas is fed into the diffuser tube 7 from above in the diffuser system 4 shown on the right.

A control device 15 is further indicated in FIG. 3, which can be realized as part of a central fire alarm system (BMZ). The control device 15 serves to appropriately control the inert gas source 2 when needed so as to initiate an inerting of the protected area 14 associated with the gas extinguishing system 1 or to respectively ensure that a predefined inerting level is not exceeded in the protected area 14 for a predefined or predefinable period of time.

To this end, the gas extinguishing system 1 depicted schematically in FIG. 3 is provided with a fire detection device 16 as well as a system for detecting the oxygen concentration in the protected area 14 (not shown). The fire detection device 16 is preferably configured as an aspirative system and designed to detect at least one fire characteristic in protected area 14.

The control device 15 preferably automatically controls the inert gas source 2 as a function of the fire characteristic monitoring realized by means of the fire detection device 16 such that the oxygen concentration in the protected 14 is lowered to a predefined inerting level according to a predefined sequence of events within the flooding period configured for the given protected area 14. It is thereby advantageous for the preferably automatic initiating of the inert gas source 2 to occur together with a corresponding alarm being issued. To this end, an alarm mechanism 18 is provided in the schematic depiction of FIG. 3.

The gas extinguishing system 1 is preferably further provided with the above-cited system 17 for detecting the oxygen concentration in the protected area 14 so as to ensure a sufficient amount of inert gas will be supplied to the protected area 14 in order to set and maintain the required inerting level in said protected area 14. Further flooding may be necessary to supply additional inert gas.

Figure 4A:
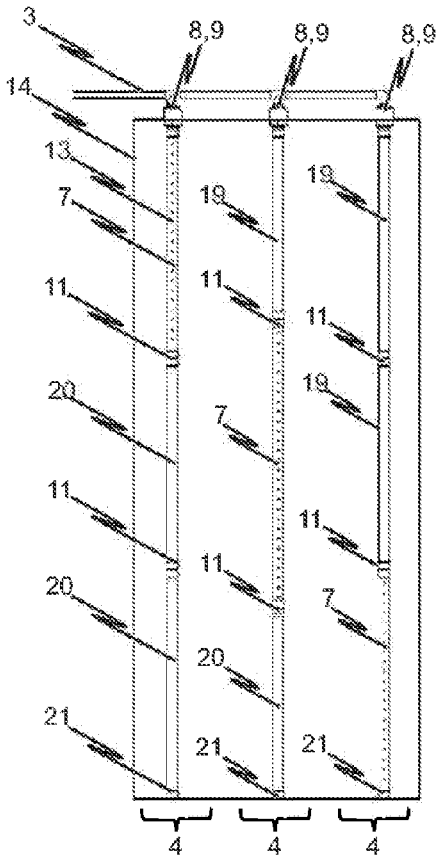
FIG. 4*a, b* schematically differing diffuser system embodiments applicable to a gas extinguishing system according to the present invention.
Figure 4B:
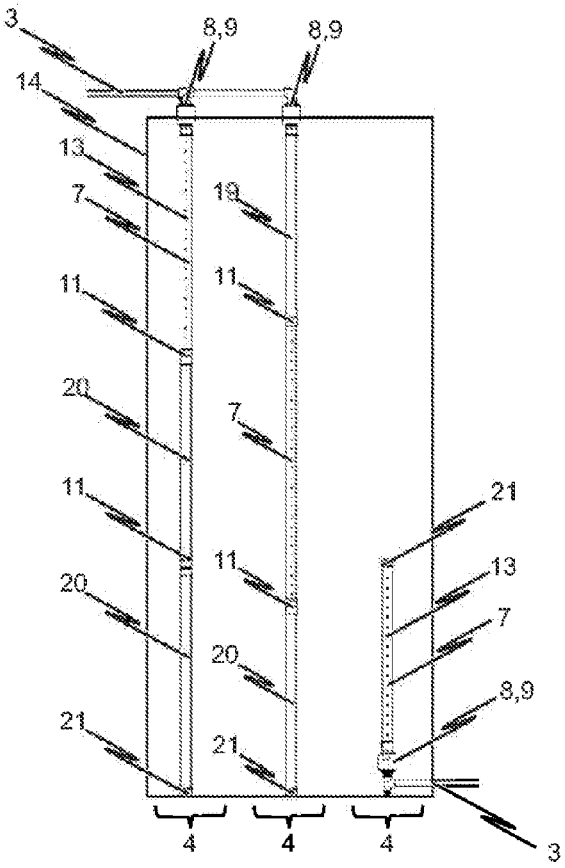

FIGS. 4*a* and 4*b* show various embodiments of diffuser systems 4 which can be used with the gas extinguishing system 1 according to the invention as non-reactive add-on components.

In detail, FIG. 4*a* shows three different embodiments of the diffuser system 4, whereby the inert gas is fed into the respective diffuser system 4 in each case from above. This type of inert gas feed from above is in particular feasible for protected areas 14 having a maximum height of 22 m.

In order to achieve as even of a dispersal of the inert gas in the protected area 14 as possible, the diffuser tube 7 of the respective diffuser systems 4 is—as indicated in FIG. 4*a*—disposed at different vertical heights. The vertical positioning of the diffuser tube 7 in the protected area 14 thereby occurs by using at least one head pipe 19 and/or by using at least one support tube 20. The head pipe(s) 19 and support tube(s) 20 are each configured without drill holes in their surfaces and primarily serve only in the vertical positioning or mechanical supporting of the respective diffuser tube 7.

FIG. 4*b* shows a configuration of diffuser systems 4 able to be used in protected areas 14 taller than 22 m. In this case, it is advantageous to partially modify the orientation; i.e. the feed of inert gas into the respective diffuser system 4, in order to distribute the respective diffuser tubes 7 over the entire height of the protected area 14.

In principle, the end region of the diffuser tube 7 opposite the pressure reducer is to be capped. This is usually effected by an end cap 21 of a tubing section 20 or other such closure.

The at least one diffuser system 4 used in the inventive gas extinguishing system 1 is designed to evenly disperse the extinguishing agent/inert gas, particularly nitrogen, within protected area 14 (extinguishing zone of small-parts storage systems) at minimum flow load. In so doing, the diffuser system 4 in the gas extinguishing system 1 assumes the structural function of the customarily employed standard extinguishing nozzle supplemented by the function of redirecting and dispersing the inert gas. The diffuser system 4 represents the terminal component of the gas extinguishing system 1 prior to the inert gas flowing into the protected area 14.

The solution according to the invention is in particular characterized by the necessary configuring specifications and design methodology for the diffuser system 4—to the extent of the configuration relating to the design and structure of the gas extinguishing system external of the protected area 14—exhibiting no difference from a standard system with extinguishing nozzles.

The pressure reducer 8 associated with the diffuser system 4 represents the system interface between the high-pressure section of the gas extinguishing system 1 and the diffuser tube 7. The pressure reducer 8 thereby separates the pressure-loaded area in the tubing system 3 (usually up to 60 bar) from the low-pressure area in the diffuser tube (maximum 1 bar positive pressure).

According to one concrete embodiment of the inventive diffuser system 4, the diffuser tube 7 is formed by a straight DN 50 stainless steel tube open at both ends, with the pressure reducer 8 arranged at its start. Up to 220 drill holes having a diameter of 3.0 mm are formed on one section of the stainless steel tube, radially arranged in a line in a 50 mm grid. The inert gas flows into the diffuser tube 7 through the pressure reducer 8 and then radially exits the drill holes 13 uniformly.

The flooding period dimensioned for the protected area 14 is stipulated in the respective national regulations, for example in the respective VdS Guidelines issued by German loss insurers.

Thus, for small-parts storage systems not yet VdS-certified for protecting equipment, the diffuser systems 4 are to be configured pursuant to e.g. VdS 2380 area protection. Area protection according to the VdS 2380 specifies inert gas extinguishing system stipulations for minimizing the risk of fire in communal areas comprising highly diverse fire loads (combustible materials) and different ignition sources. The guideline relates to extinguishing by means of inert gases and inert gas mixtures.

According to VdS 2380, the type of fire risk determines the flooding period (95% extinguishing gas concentration passage) for small-parts storage systems at a maximum of 60 or 120 seconds in addition to the specified concentration and the dwell time of 10 or 20 min respectively.

The invention is not limited to the example embodiments schematically depicted in the drawings but rather yields from a synopsis of all the features disclosed herein together.

LIST OF REFERENCE NUMERALS

1 gas extinguishing system
2 inert gas source
2.1 pressure cylinder/pressure tank
3 tubing system
4 diffuser system
5 valve with pressure reducer
6 control box
7 diffuser tube
7.1, 7.2, 7.3 diffuser tube segments
8 pressure reducer
9 baffle
10 adapter piece
11 connecting piece
12 seal
13 drill hole
14 protected area
15 control device
16 fire detection device
18 alarm mechanism
19 head pipe
20 support tube
21 closure

What is claimed is:

1. A gas extinguishing system for a predefined protected area, wherein the gas extinguishing system comprises:

an inert gas source, designed to provide inert gas at least during a flooding period dimensioned for the protected area; and a diffuser system fluidly connected or connectable to the inert gas source by a tubing system, wherein the diffuser system includes:

at least one diffuser tube having a plurality of drill holes provided in a surface of the diffuser tube through which at least a portion of the inert gas provided by the inert gas source is introduced radially into the protected area relative to a longitudinal direction of the diffuser tube; and a pressure reducer allocated to the at least one diffuser tube including a baffle, wherein the pressure reducer is fluidly disposed between the tubing system and the at least one diffuser tube and separates the tubing system, which is at a maximum of 60 bar, from the diffuser tube defining a low-pressure area relative to the tubing system, the diffuser system operating with a primary baffle pressure, associated with the baffle, measured in absolute bar that is at least twice as high as an internal pressure of the diffuser tube during the flooding period, and the diffuser system operating with the internal pressure of the diffuser tube during the flooding period amounts to a maximum of 2 bar absolute.

2. The gas extinguishing system according to claim 1, wherein a same mass flow of inert gas is discharged from the drill holes formed in the surface of the at least one diffuser tube during the flooding period.

3. The gas extinguishing system according to claim 1, wherein the respective drill holes provided in the surface of the at least one diffuser tube have a predefined bore diameter, and wherein the plurality of drill holes provided in the surface of the at least one diffuser tube are further arranged according to a fixed bore spacing grid.

4. The gas extinguishing system according to claim 1, wherein the drill holes provided in the surface of the at least one diffuser tube are configured to respectively release the inert gas into the protected area during the flooding period as a subcritical flow.

5. The gas extinguishing system according to claim 1, wherein the drill holes provided in the surface of the at least one diffuser tube have a constant cross section.

6. The gas extinguishing system according to claim 1, wherein, relative to a bore surface, an amount of inert gas released into the protected area through each individual drill hole of the at least one diffuser tube per second during the flooding period does not exceed a predefined value of 4.86×105 liter/(s×m2 bore surface) measured at 20° C. and 1.013 bar.

7. The gas extinguishing system according to claim 1, wherein, relative to an internal cross-sectional area of the at least one diffuser tube, a total amount of inert gas released into the protected area through the drill holes of the at least one diffuser tube per second during the flooding period does not exceed a predefined value of 2.92×105 liter/(s×m2 internal cross-sectional area), measured at 20° C. and 1.013 bar.

8. The gas extinguishing system according to claim 1, wherein nitrogen or a nitrogen-enriched gas mixture is used as the inert gas, and wherein an amount of inert gas released per second into the protected area through each individual drill hole of the at least one diffuser tube during the configured flooding period does not exceed a predefined value of approximately 0.004 kg/s; and/or wherein nitrogen or a nitrogen-enriched gas mixture is used as the inert gas, and wherein the diffuser system operating with a total amount of inert gas released per second into the protected area through the drill holes of the at least one diffuser tube during the flooding configured period does not exceed a predefined value of approximately 0.75 kg/s.

9. The gas extinguishing system according to claim 1, wherein the inert gas source comprises at least one inert gas pressure tank in which the inert gas is stored in compressed form.

10. The gas extinguishing system according to claim 1, wherein the at least one diffuser tube is positioned vertically in the protected area, and where the diffuser system further including at least one fluidly connected head pipe arranged between the pressure reducer and the diffuser tube through which inert gas is piped from the pressure reducer to the diffuser tube.

11. The gas extinguishing system according to claim 1, wherein the diffuser system further includes at least one support tube which terminates the at least one diffuser tube.

12. The gas extinguishing system according to claim 1, wherein the at least one diffuser tube is configured as a straight tube without bends, angles or T-pieces.

13. The gas extinguishing system according to claim 1, wherein the at least one diffuser tube is formed from a plurality of separately formed segments, wherein the plurality of separately formed segments are fluidly connected to one another by means of a cold-press connection.

14. The gas extinguishing system according to claim 1, wherein the gas extinguishing system further comprises the following:

a fire detection device operating to detect at least one fire characteristic in the protected area; and a control device operating to automatically control the inert gas source as a function of the at least one fire characteristic monitoring and lower oxygen concentration in the protected area to a predefined inerting level according to a predefined sequence of events within the flooding period set for the protected area and maintain it at the inerting level for a predefined dwell time.

15. The gas extinguishing system according to claim 14, further comprising at least one system operating to detect the oxygen concentration in the protected area is further provided.

16. The gas extinguishing system according to claim 2, wherein the respective drill holes provided in the surface of the at least one diffuser tube exhibit a predefined bore diameter, and wherein the plurality of drill holes provided in the surface of the at least one diffuser tube are further arranged according to a fixed bore spacing grid.

17. The gas extinguishing system according to claim 2, wherein the drill holes provided in the surface of the at least one diffuser tube are configured to respectively release the inert gas into the protected area during the flooding period as a subcritical flow.

18. The gas extinguishing system according to claim 3, wherein the drill holes provided in the surface of the at least one diffuser tube are configured to respectively release the inert gas into the protected area during the dimensioned flooding period as a subcritical flow.

19. The gas extinguishing system according to claim 2, wherein the drill holes provided in the surface of the at least one diffuser tube have a constant cross section.

20. The gas extinguishing system according to claim 3, wherein the drill holes provided in the surface of the at least one diffuser tube have a constant cross section.

* * * * *